US006520222B2

(12) United States Patent
Carmack et al.

(10) Patent No.: US 6,520,222 B2
(45) Date of Patent: Feb. 18, 2003

(54) FUEL DISPENSING NOZZLE HAVING A DRIPLESS SPOUT

(75) Inventors: Paul D. Carmack, Tipp City, OH (US); Robert D. Murphy, Huber Heights, OH (US)

(73) Assignee: Catlow, Inc., Tipp City, OH (US)

( * ) Notice: Subject to any disclaimer, the term of this patent is extended or adjusted under 35 U.S.C. 154(b) by 0 days.

(21) Appl. No.: 09/919,443

(22) Filed: Jul. 31, 2001

(65) Prior Publication Data

US 2002/0014278 A1 Feb. 7, 2002

Related U.S. Application Data

(60) Provisional application No. 60/221,997, filed on Jul. 31, 2000.

(51) Int. Cl.[7] ..... B65B 1/04

(52) U.S. Cl. ..... 141/311 A; 141/206; 141/208

(58) Field of Search ..... 141/311 A, 206–226, 141/392

(56) References Cited

U.S. PATENT DOCUMENTS 5,377,729 A 1/1995 Reep
5,603,364 A 2/1997 Kerssies
5,620,032 A 4/1997 Dame
5,645,116 A 7/1997 McDonald
5,765,609 A * 6/1998 Dalhart et al. ..... 138/113
5,832,970 A 11/1998 Carow

* cited by examiner

*Primary Examiner*—Steven O. Douglas
(74) *Attorney, Agent, or Firm*—Jacox, Meckstroth & Jenkins

(57) ABSTRACT

A vapor assisted fuel dispensing nozzle has a projecting aluminum outer spout tube surrounding an internal fuel supply tube, and the tubes define therebetween a vapor return passage. The inner fuel supply tube extends from a spring biased poppet valve for producing a venturi suction in response to fuel flow. The outer spout tube encloses a stainless steel spout extension reinforcing tube having peripherally spaced vapor return flutes or grooves and an internal valve seat at the distal end for receiving a recessed valve member. In one embodiment, the valve member is connected by a stiff wire to a spring biased fuel pressure sensing disk slidable within a cylinder located upstream of the poppet valve. In another embodiment, the valve member is guided by a cup-shaped cage recessed within a tip chamber of the extension tube.

20 Claims, 4 Drawing Sheets

FUEL DISPENSING NOZZLE HAVING A DRIPLESS SPOUT

RELATED APPLICATION

This application claims the benefit of provisional patent application Ser. No. 60/221,997, filed Jul. 31, 2000.

BACKGROUND OF THE INVENTION

The present invention relates to a vapor assisted fuel dispensing nozzle of the general type disclosed in U.S. Pat. No. 5,832,970, the disclosure of which is herein incorporated by reference. In such a nozzle, it is sometimes desirable to provide for a shut-off valve at the tip of the nozzle spout and in the fuel supply passage to avoid drips from the spout after the nozzle is removed from the fill tube for a fuel tank of the motor vehicle. Various forms of spout tip valve systems for a fuel passage of a fuel dispensing nozzle are disclosed in U.S. Pat. Nos. 5,377,729, 5,645,116, 5,620,032, and 5,603,364. The nozzle assembly disclosed in the '364 patent incorporates an extruded aluminum spout having a center passage or channel through which a wire extends to a valve closure cap positioned at the outer end of the spout. The inner end portion of the wire connects with an axially movable valve member which shifts downstream to an open position to allow fuel to flow and for opening the spout tip cap in response to the flow of fuel into the nozzle spout. The nozzle assembly disclosed in the '116 patent incorporates a spring biased and fuel flow responsive valve member supported by a fitting threaded into the outer end of the fuel supply tube.

SUMMARY OF THE INVENTION

The present invention is directed to an improved vapor recovery fuel dispensing nozzle which includes a body adapted to be connected to a coaxial hose defining a fuel supply passage and a vapor return passage and a hand actuated control valve for a fuel supply passage within the body. The nozzle includes a projecting aluminum spout tube surrounding an internal plastic or metal fuel supply tube which cooperates to define an inner fuel supply passage and an outer vapor return passage around the fuel supply tube. The inner fuel supply tube extends from a spring biased poppet valve which produces a venturi suction in response to fuel flow for actuating a diaphragm mechanism which automatically closes the fuel control valve when the suction at the spout tip is blocked by fuel, in a conventional manner.

The outer spout tube receives a reinforcing stainless steel spout extension tube having peripherally spaced and axially extending vapor return grooves and a counterbore defining an internal annular valve seat for receiving a recessed tip valve member. In one embodiment, the tip valve member comprises a ball connected by a wire to a spring biased fuel pressure sensing disk slidable within a cylinder upstream of the poppet valve. When fuel is supplied to the spout assembly after the fuel valve is manually opened, the fuel pressure sensing disk is depressed against the compression spring for moving the tip valve member or ball to its open position. As soon as the fuel supply is shut off by closing of the fuel control valve, the pressure sensing disk returns to its normal position by the compression spring and moves the tip valve ball to its recessed closed position to prevent any fuel drips from the spout assembly. In another embodiment, the tip valve member is guided between its open a d closed positions by a cage recessed within the counterbore and an outwardly projecting valve stem surrounded by a compression spring.

Other features and advantages of the invention will be apparent from the following description, the accompanying drawings and the appended claims.

DESCRIPTION OF THE PREFERRED EMBODIMENT

Figure 1:
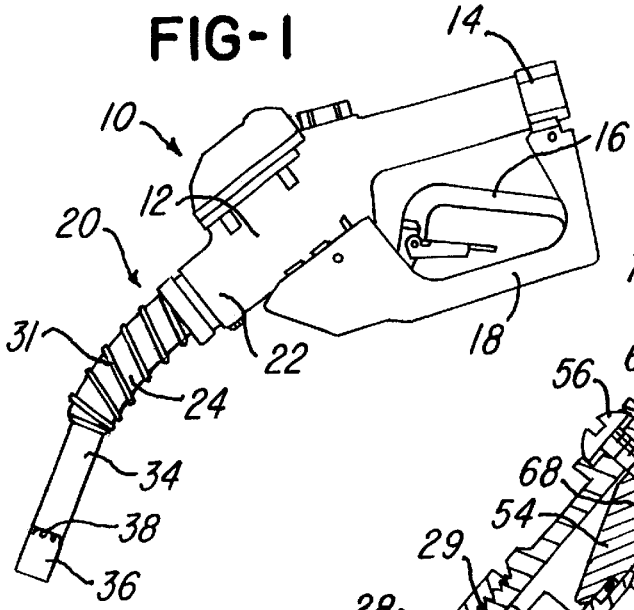
FIG. 1 is a side elevational view of a vacuum assist vapor recovery fuel dispensing nozzle constructed in accordance with the invention.

FIG. 1 illustrates a vacuum assist vapor recovery fuel dispensing nozzle 10 constructed in accordance with the invention and having the general construction of the dispensing nozzle disclosed in above-mentioned U.S. Pat. No. 5,832,970, the disclosure which is incorporated by reference. The nozzle 10 includes a die cast aluminum body 12 having an integral internally threaded fitting 14 for receiving a mating fitting on a coaxial flexible rubber hose (not shown) defining a fluid supply passage and a vapor return passage connected to a vacuum source. The nozzle 10 includes a fuel control valve (not shown) which may be actuated by squeezing a hand lever 16 which is enclosed within a protector housing 18.

The nozzle body 12 supports a spout assembly 20 which projects from a forward portion 22 of the nozzle body 12. The spout assembly 20 includes an outer spout tube 24 constructed of aluminum tubing and having an inner end portion threaded into an anti-rotation ring or fitting 26 secured to the body end portion 22 by a retaining nut 28. A resilient O-ring 29 forms a fluid-tight seal between the fitting 26 and the body portion 22, and a helically wound spring wire 31 surrounds the spout tube 24, in a conventional manner. The aluminum outer spout tube 24 includes an integral cylindrical forward end portion 34 having a thinner wall thickness and which surrounds a stainless steel vapor recovery extension spout tube 36.

The spout extension tube 36 has circumferentially spaced and axially extending slots or grooves 38 and defines a nozzle tip chamber 41 extending from an annular shoulder or valve seat 42. The outer end portions of the grooves 38 are exposed at the end of the spout portion 34 and form corresponding vapor return passages which extend to a vapor return passage 44 defined between the outer aluminum spout tube 24 and an inner fuel supply tube 46 extruded of a plastics material such as nylon. The outer end portion of the plastic fuel supply tube 46 is press-fitted into the spout extension tube 36, and the inner end portion of the fuel supply tube 46 is concentrically supported within the fitting 26 by a spacing collar 48 having four circumferentially spaced ribs.

The inner fuel supply tube 46 and the extension tube spout 36 define a fuel supply passage 50 which receives fuel through a die cast aluminum spout housing or valve body 54 having a forward portion receiving and sealed to the rearward end portion of the fuel tube support collar 48. The valve body 54 is secured within the forward end portion 22 of the nozzle body 12 by a screw 56, and a rearward end portion of the valve body 54 has internal threads for receiving an annular tapered valve skirt or seat member 58. A frusto-conical poppet valve member 62 normally engages the tapered valve seat member 58 and is supported for axial movement by a center valve stem slidable within a bore 64 formed within a hub portion 66 of the valve body 54. A set of four circumferentially spaced ribs 68 support the hub portion 66 and define fuel supply passages between the ribs.

A compression spring 71 normally biases the poppet valve member 62 to its closed position engaging the seat member 58 which, in a conventional manner, defines peripherally spaced venturi ports 73. The ports 73 produce a suction within a passage 76 within the valve body 12 when fuel flows from a chamber 77 past the poppet valve member 62 for actuating a fuel shut-off diaphragm 78 in a conventional manner. A small flexible plastic tube (not shown in FIGS. 2 & 3) connects with the passage 76 and extends within the vapor return chamber 44 within the outer spout tube 24. The outer end portion of the suction tube extends within one of the grooves 38 so that the outer end of the suction tube is open at the outer end of one of the grooves 38. When a suction is created by the venturi ports 73, the suction pulls air through the small plastic suction tube so that the vacuum within the passage 76 is very low. When the fuel tank is filled and fuel blocks the air suction inlet within the small suction tube, the suction pressure in the passage 76 substantially increases and actuates the diaphragm 78 to release the fuel valve so that it returns to its normally closed position, in a conventional manner.

Figure 2:
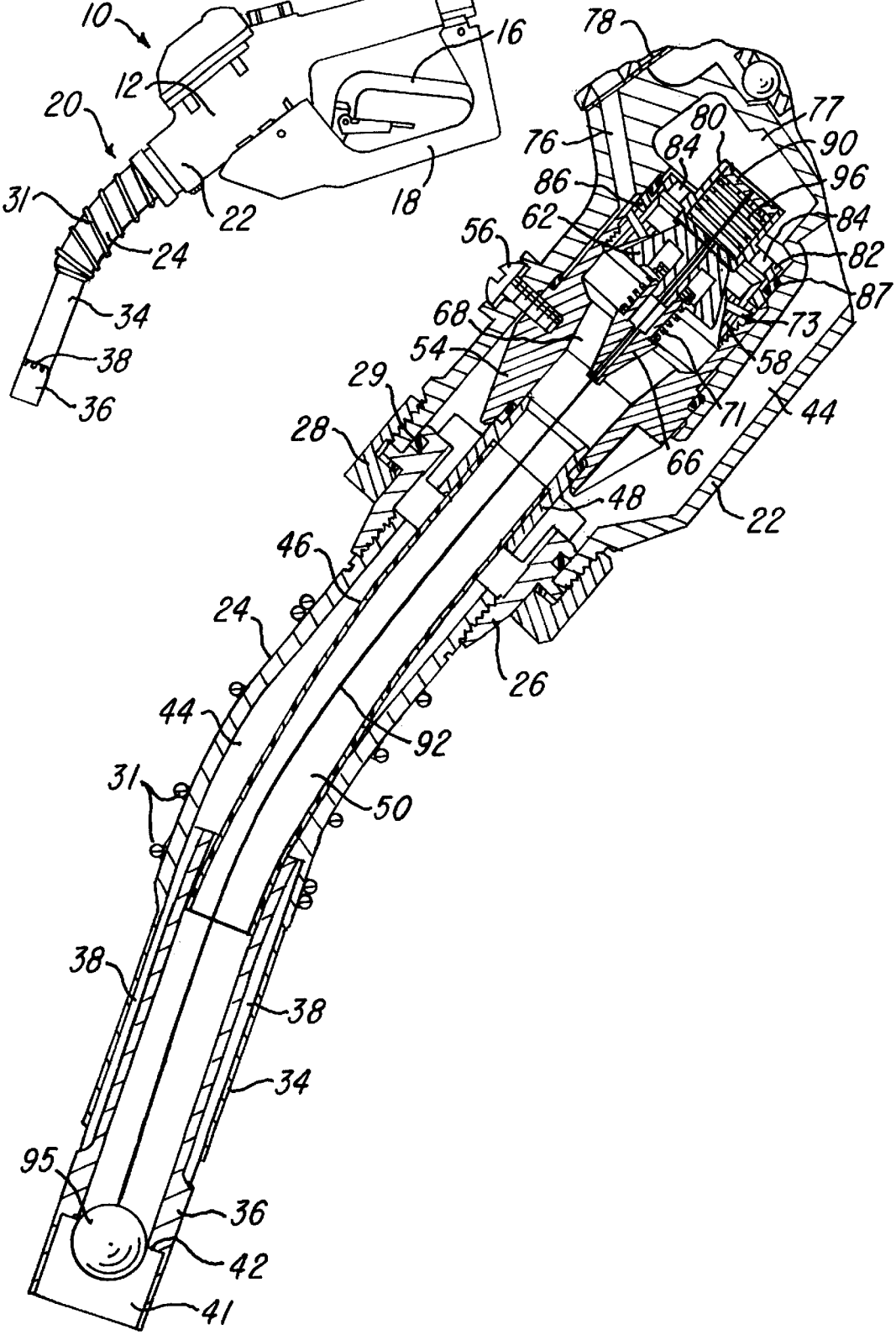
FIG. 2 is a fragmentary section view of the spout assembly shown in FIG. 1 and incorporating a spout tip valve and actuating mechanism constructed in accordance with one embodiment of the invention and shown in its closed position.
Figure 4:
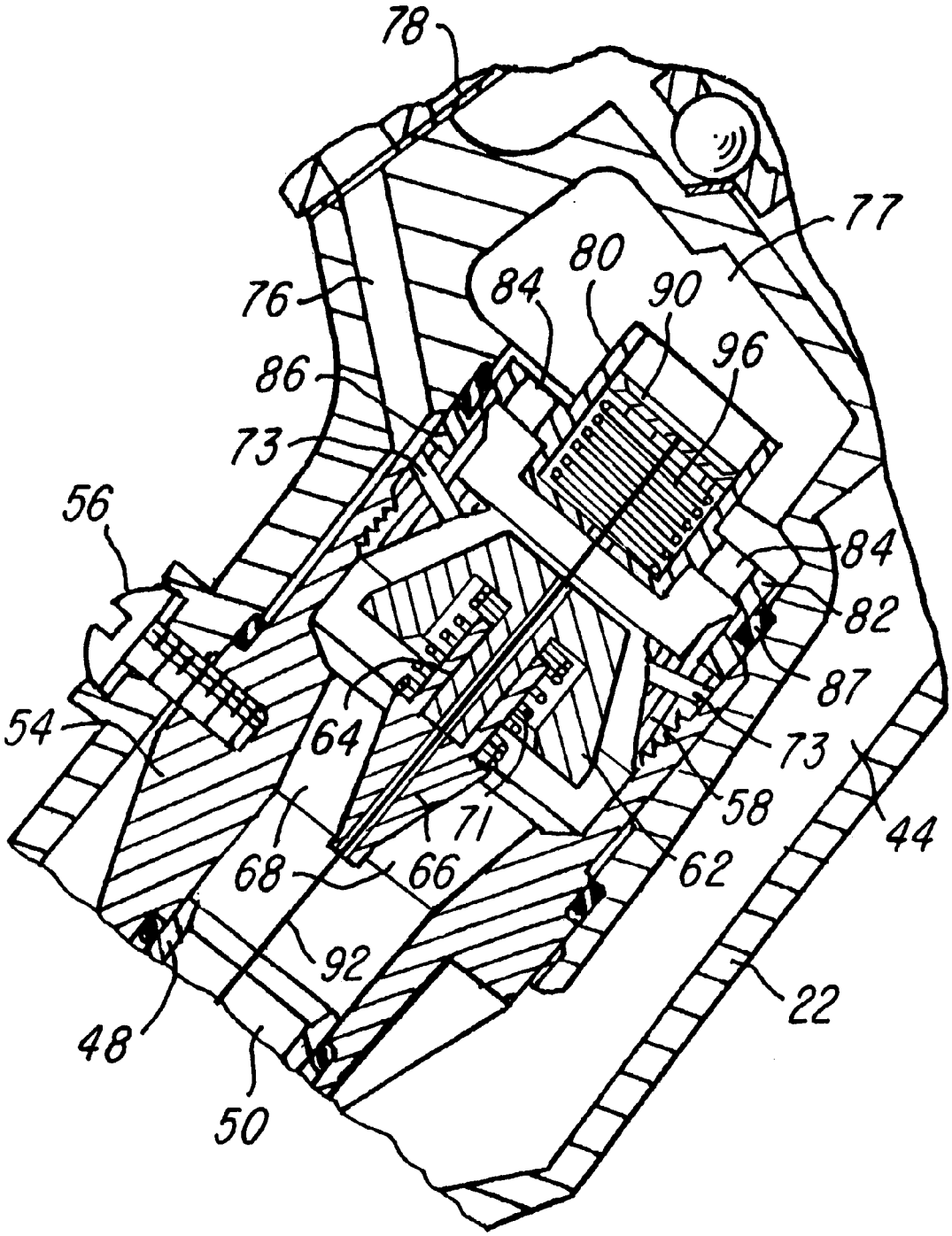
FIG. 4 is an enlarged fragmentary section of the fuel dispensing nozzle shown in FIG. 3 with the tip valve actuating mechanism in its open position.

Referring to FIG. 4, a cylinder 80 is positioned within the fuel supply chamber 77 and has an outwardly projecting flange portion 82 with a series of eight circumferentially spaced fuel passages or ports 84. A generally cylindrical skirt portion 86 depends from the flange portion 82 and is retained against a resilient sealing ring 87 by the annular venturi valve seat member 58. A fuel pressure sensing disk 90 is free to slide axially within the cylinder 80 and is connected to the inner end portion of a stiff stainless steel actuating wire 92. The wire 92 extends through a clearance hole within the bottom wall of the cylinder 80, a clearance hole within the poppet valve member 62 and a clearance hole within the hub portion 66 of the valve body 54. As shown in FIG.2, the actuating wire 92 extends through the fuel supply tube 46 and the stainless steel spout extension tube 36 to a valve closure element or member 95, preferably in the shape of a sphere or ball formed of a plastics material such as Nylon. The outer end portion of the wire 92 is positively secured to the closure ball 95, preferably by adhesive, and the inner end portion of the wire is positively attached to the center of the sensing disk 90. A relatively light compression spring 96 is confined within the cylinder 80 and normally urges the disk 90 to its closed position (FIG. 2) where the wire 92 pulls the closure ball 95 to its closed position against the valve seat 42.

Figure 3:
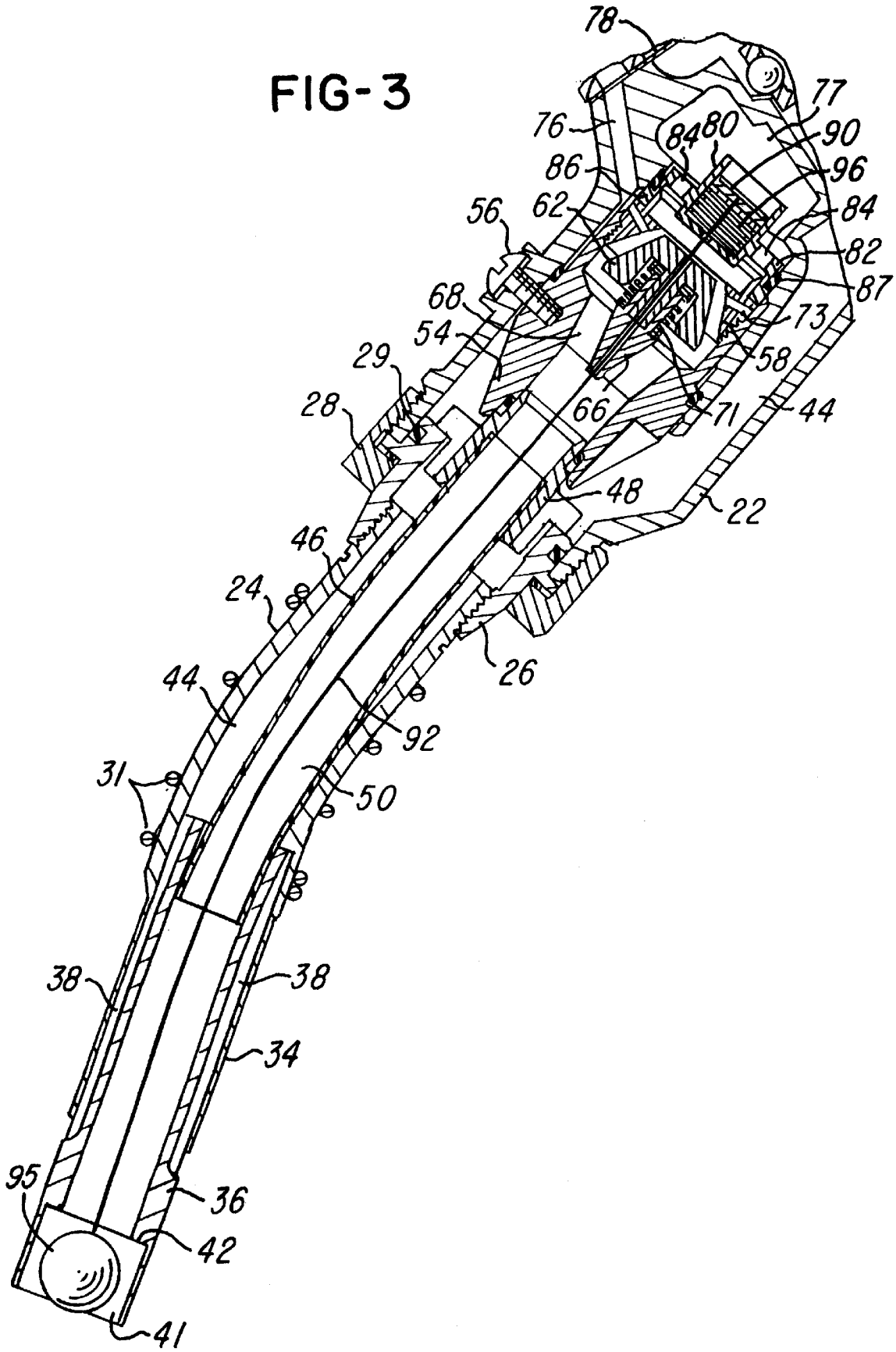
FIG. 3 is a fragmentary section view similar to FIG. 2 and with the spout tip valve mechanism in its open position.

When the valve actuating lever 16 is manually squeezed to open the fuel control valve, the fuel flows through the chamber 77 and the ports 84 and moves the poppet valve member 62 against the spring 71 to an open position (FIGS. 3 and 4). Simultaneously, the pressure of the fuel within the chamber 77 acts on the disk 90 and moves the disk from its closed position against the spring 96 to its open position (FIGS. 3 and 4) so that the stiff stainless steel wire 92 moves the closure ball 95 to its open position (FIG. 3) within the chamber 41. The fuel to flow through the fuel tube 46 and spout extension tube 36 and around the closure ball 95 into the inlet tube (not shown) of the motor vehicle fuel tank. When the main fuel valve in the nozzle is closed due to the release of the hand lever 16 or by actuation of the overflow diaphragm mechanism, the fuel pressure within the chamber 77 drops so that the sensing disk 90 and the valve member or closure ball 95 return to their normally closed positions (FIG. 2) in response to the force of the spring 96.

Figure 5:
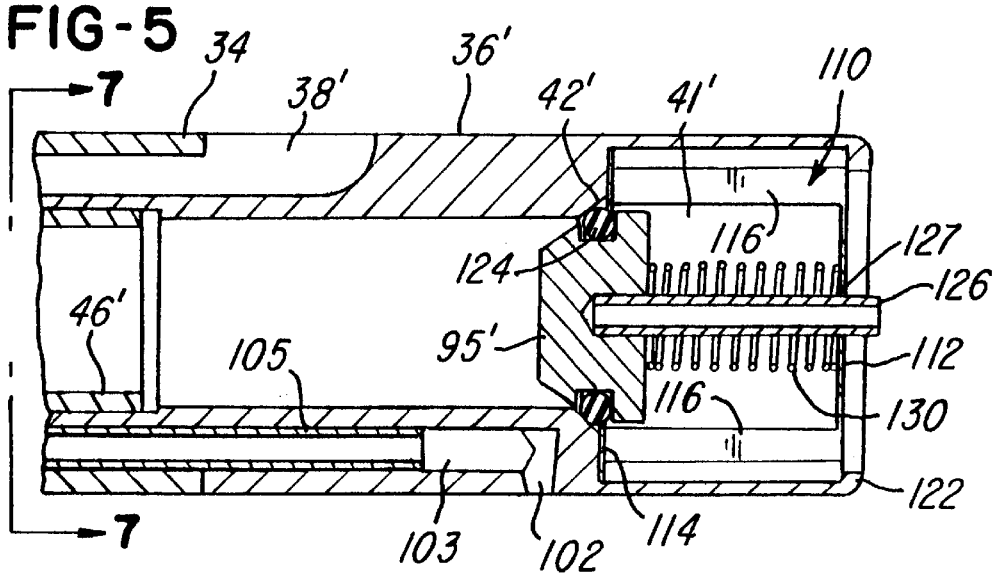
FIG. 5 is an enlarged axial section of the outer end portion of a spout assembly constructed in accordance with another embodiment of the invention and showing the tip valve member in its closed position.

Referring to FIGS. 5–8 which illustrate a modification or another embodiment of the invention, the cylindrical end portion 34 of the outer spout tube 24 receives a stainless steel spout extension tube 36' which is constructed substantially the same as the extension tube 36. Accordingly, the same reference numbers are used to identify corresponding structure of the extension tube 36', but with the addition of a prime mark. The extension tube 36' has an inner end portion with a slightly reduced diameter and with circumferentially spaced and axially extending part-cylindrical grooves 38' which project outwardly axially beyond the end of the tube 34 and form vapor return passages connected to the annular vapor return passage 44. Preferably, the inner end portion of the extension tube 36' is press-fitted into the end portion of the tube 34 but may be connected by a suitable adhesive. As shown in FIG. 5, the inner end portion of the extension tube 36' receives the outer end portion of a metal fuel supply tube 46'but the tube 46' may be of a suitable plastics material such as the tube 46 disclosed above in connection with FIGS. 1–3. The distal end or tip portion of the extension tube 36' has a counter-bore defining a tip chamber 41' and an internal annular tapered valve seat 42'. A radial suction port 102 is also formed in the spout extension tube 36' and connects with an axially extending bore 103 which receives a small diameter metal suction tube 105. The inner end portion of the tube 105 is connected by a flexible plastic suction tube to the passage 76 (FIG. 3), in a conventional manner, for actuating the diaphragm valve release mechanism to shut off the main fuel supply valve when fuel blocks the air suction port 102.

A cup-shaped cylindrical cage member 110 is positioned within the tip chamber 41' and includes a thin gear-shaped outer end wall 112 integrally connected to a thin annular inner end wall 114 by circumferentially spaced and axially extending ribs 116. The cage 110 is retained within the chamber 41' by rolling the outer annular tip portion 122 of the extension tube 36' inwardly, as shown in FIG. 5. A plug-like valve member 95' has an annular groove which receives a resilient O-ring 124 for normally engaging the annular tapered valve seat 42'. The valve member 95' is mounted on the inner end portion of a stainless steel tubular guide pin 126 which projects axially through a guide hole 127 within the outer end wall 112 of the cage 110. The pin 126 and the inner surfaces of the cage ribs 116 guide the valve member 95' between its closed position (FIG. 5) and its open position (FIG. 6).

A compression coil spring 130 surrounds the guide pin 126 and extends between the valve member 95 and the outer end wall 112 of the cage 110 for normally biasing the valve member 95 to its closed position. The force exerted by the spring 130 is selected so that when fuel flows outwardly through the spout extension tube 36' the pressure of the fuel forces the valve member 95 to its open position where the fuel flows outwardly around the valve member and between the ribs 116 for discharge through the outer tip portion 122 of the spout extension tube 36'. When the fuel flow is shut off, the spring 130 moves the valve member 95' back to its closed position shown at FIG. 5 and thereby prevents any dripping of fuel from the spout assembly.

From the drawings and the above description, it is apparent that a fuel dispensing nozzle constructed in accordance with the present invention, provides desirable features and advantages. As one feature of the embodiment of FIGS. 1–4, the position of the ports 84 outboard of the fuel pressure sensing cylinder 80 does not restrict the flow of fuel through the nozzle. In addition, the assembly of the spring biased pressure sensing disk 90, the actuating wire 92 and the closure or valve member or ball 95 is simple and dependable in operation for an extended period of service. When the valve member or ball 95 is in its closed position (FIG. 2), fuel is prevented from dripping from the fuel supply passage 50 and provides the dispensing nozzle 10 with a dripless spout assembly 20. The valve member or ball 95 is also confined within the tip chamber 41 both in its open position and its closed position and is thereby protected from being damaged.

Figure 6:
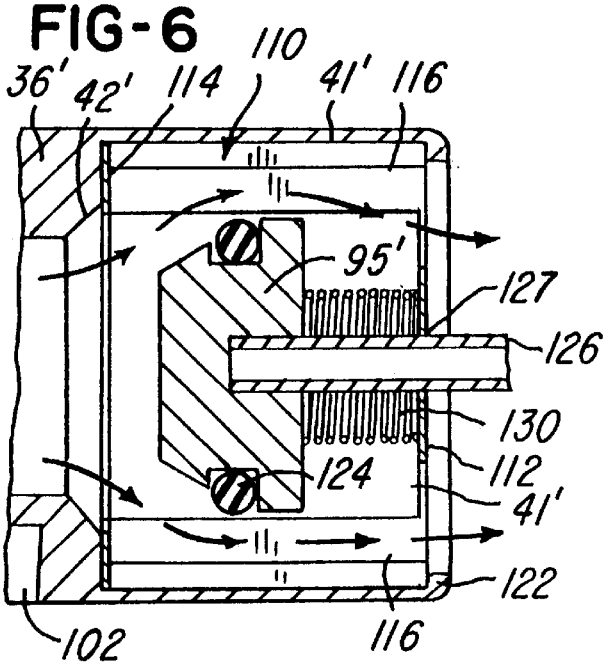
FIG. 6 is an enlarged axial section of the tip portion shown in FIG. 5 and with the valve member in its open position.
Figure 7:
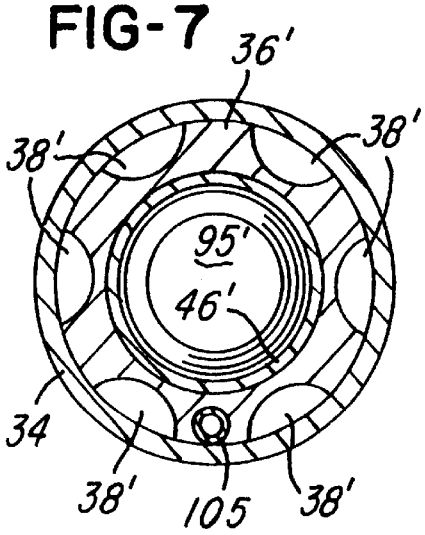
FIG. 7 is a radial section taken generally on the line 7—7 of FIG. 5.
Figure 8:
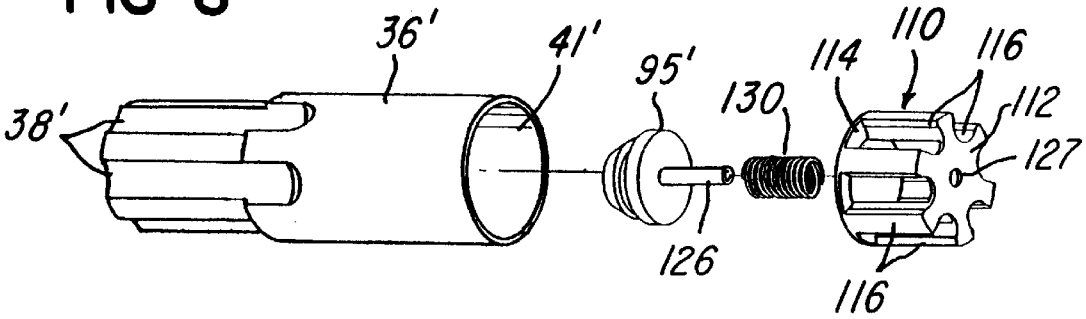
FIG. 8 is an exploded perspective view of the assembled spout components shown in FIG. 5.

In both of the embodiments of FIGS. 1–4 and FIGS. 5–8, the stainless steel extension spout 36 or 36' not only reinforces the aluminum spout tube 34, but also provides high wear resistance and can withstand considerable abuse while also assuring that the vapor return grooves or passages 38 remain open and do not trap fuel. The spout tip valve assembly of FIGS. 5–8 also provides a dependable flow responsive valve with the cage 110 and pin 126 guiding the valve member 95' between a positive closed position (FIG. 5) and an open position (FIG. 6). The cage 110 also reinforces the tip end portion of the extension spout 36' and permits a smooth flow of fuel around the valve member 95'.

While the nozzle assemblies herein described constitute preferred embodiments of the invention, it is to be understood that the invention is not limited to these precise form of assemblies, and that changes may be made therein without departing from the scope and spirit of the invention as defined in the appended claims.

What is claimed is:

1. In a fuel dispensing nozzle including a nozzle body defining a fuel supply passage and a fuel vapor return passage, and a manually actuated valve for controlling the supply of fuel through said fuel supply passage, an improved spout assembly projecting from said body, comprising an outer spout tube having an inner end portion connected to said body and an outer end portion, a fuel supply tube within said outer spout tube and a defining therebetween a vapor return passage, a spout extension tube having an inner end portion projecting into said outer end portion of said outer spout tube and connected to said fuel supply tube, said spout extension tube having circumferentially spaced and generally axially extending grooves forming corresponding vapor return passages between said spout extension tube and said outer end portion of said outer spout tube, said vapor return passages having open ends at a distal end of said outer spout tube, and said spout extension tube reinforces said outer end portion of said outer spout tube.

2. A fuel dispensing nozzle as defined in claim 1 wherein said spout extension tube comprises a stainless steel tube.

3. A fuel dispensing nozzle as defined in claim 1 wherein said spout extension tube has a distal end with a counterbore defining a cylindrical tip chamber extending to an annular valve seat, and a spring bias valve member within said tip chamber and normally engaging said valve seat.

4. A fuel dispensing nozzle as defined in claim 3 and including a fuel pressure sensing disk supported for axial movement by a cylinder within said body and a stiff wire member extending through said fuel supply tube and connecting said disk to said valve member.

5. A fuel dispensing nozzle as defined in claim 3 and including a generally cylindrical cage within said tip chamber and supporting said valve member for axial movement between a closed position engaging said valve seat and an open position wherein fuel flows around said valve member and through circumferentially spaced slots within said cage.

6. A fuel dispensing nozzle as defined in claim 5 and including a guide pin having an inner end portion connected to said valve member and supported for axial movement by an outer end wall of said cage, and a compression spring surrounding said guide pin and extending between said outer end wall of said cage and said valve member.

7. A fuel dispensing nozzle as defined in claim 3 wherein said valve seat comprises an annular tapered seat, and said valve member supports a resilient sealing ring.

8. A fuel dispensing nozzle as defined in claim 1 wherein said spout extension tube defines an axially extending suction passage connected to a radial port within a distal end portion of said spout extension tube.

9. A fuel dispensing nozzle as defined in claim 1 wherein said outer spout tube is aluminum and said inner end portion is larger in diameter than the diameter of said outer end portion, and said spout extension tube is stainless steel and has peripherally spaced and axially extending ribs defining said grooves and reinforcing said outer end portion of said outer spout tube.

10. A fuel dispensing nozzle as defined in claim 1 wherein said grooves extend axially beyond a distal end of outer spout tube.

11. In a fuel dispensing nozzle including a nozzle body defining a fuel supply passage and a fuel vapor return passage, and a manually actuated valve for controlling the supply of fuel through said fuel supply passage, an improved spout assembly projecting from said body, comprising an outer spout tube having an inner end portion connected to said body and an outer end portion, a fuel supply tube within said outer spout tube and a defining therebetween a vapor return passage, a spout extension tube having an inner end portion projecting into said outer end portion of said outer spout tube and connected to said fuel supply tube, said spout extension tube having circumferentially spaced and generally axially extending grooves forming corresponding vapor return passages between said spout extension tube and said outer end portion of said outer spout tube, said vapor return passages having open ends at a distal end of said outer spout tube, said spout extension tube having a distal end with a counterbore defining a cylindrical tip chamber extending to an annular valve seat, a generally cylindrical cage within said tip chamber and supporting a valve member for axial movement between a closed position engaging said valve seat and an open position wherein fuel flows around said valve member and through circumferentially spaced slots within said cage, and a compression spring within said cage and biasing said valve member inwardly towards said valve seat.

12. A fuel dispensing nozzle as defined in claim 11 wherein said spout extension tube comprises a stainless steel tube.

13. A fuel dispensing nozzle as defined in claim 11 and including a guide pin having an inner end portion connected to said valve member and supported for axial movement by an outer end wall of said cage, and said spring surrounds said guide pin and extends between said outer end wall of said cage and said valve member.

14. A fuel dispensing nozzle as defined in claim 11 wherein said spout extension tube defines an axially extending suction passage connected to a radial port within a distal end portion of said spout extension tube.

15. A fuel dispensing nozzle as defined in claim 11 wherein said outer spout tube is aluminum and said inner end portion is larger in diameter than the diameter of said outer end portion, and said spout extension tube is stainless steel and has peripherally spaced and axially extending ribs defining said grooves and reinforcing said outer end portion of said outer spout tube.

16. A fuel dispensing nozzle as defined in claim 11 wherein said grooves extend axially beyond a distal end of outer spout tube.

17. In a fuel dispensing nozzle including a nozzle body defining a fuel supply passage, and a manually actuated valve for controlling the supply of fuel through said fuel supply passage, an improved spout assembly projecting from said body, comprising a spout tube having an inner end portion connected to said body and an outer end portion, said spout tube having a distal end with a counterbore defining a cylindrical tip chamber extending to an annular valve seat, a generally cylindrical cage within said tip chamber and supporting a valve member for axial movement between a closed position engaging said valve seat and an open position wherein fuel flows around said valve member and through circumferentially spaced slots within said cage, and a compression spring within said cage and biasing said valve member towards said valve seat.

18. A fuel dispensing nozzle as defined in claim 17 and including a guide pin having an inner end portion connected to said valve member and supported for axial movement by an outer end wall of said cage, and said compression spring surrounds said guide pin and extends between said outer end wall of said cage and said valve member.

19. A fuel dispensing nozzle as defined in claim 17 wherein said valve seat comprises an annular tapered seat, and said valve member supports a resilient sealing ring.

20. A fuel dispensing nozzle as defined in claim 17 wherein said cage has an annular inner end wall and an outer end wall defining openings, and peripherally spaced axially extending ribs integrally connect said inner and outer walls of said cage.

* * * * *